US010148068B2

(12) United States Patent
Ishiguro et al.

(10) Patent No.: US 10,148,068 B2
(45) Date of Patent: Dec. 4, 2018

(54) SPARK PLUG AND SEMI-FINISHED PRODUCT THEREOF

(71) Applicant: DENSO CORPORATION, Kariya, Aichi-pref. (JP)

(72) Inventors: Hiroya Ishiguro, Kariya (JP); Tomoaki Yonekura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/813,386

(22) Filed: Nov. 15, 2017

(65) Prior Publication Data

US 2018/0138665 A1 May 17, 2018

(30) Foreign Application Priority Data

Nov. 17, 2016 (JP) ..... 2016-223870
Jun. 30, 2017 (JP) ..... 2017-129362

(51) Int. Cl.

| | |
|---|---|
| ***H01T 13/20*** | (2006.01) |
| ***H01T 13/08*** | (2006.01) |
| ***H01T 13/36*** | (2006.01) |
| ***H01T 13/12*** | (2006.01) |

(52) U.S. Cl.
CPC ..... *H01T 13/20* (2013.01); *H01T 13/08* (2013.01); *H01T 13/12* (2013.01); *H01T 13/36* (2013.01)

(58) Field of Classification Search
CPC ..... H01T 13/20; H01T 13/36; H01T 13/12
See application file for complete search history.

(56) References Cited

U.S. PATENT DOCUMENTS 6,373,173 B1 * 4/2002 Suzuki ..... H01T 13/20 313/135
6,566,793 B2 5/2003 Honda et al.
2003/0102791 A1 6/2003 Suzuki

FOREIGN PATENT DOCUMENTS

JP 2016-207585 12/2016

* cited by examiner

*Primary Examiner* — Donald L Raleigh
(74) *Attorney, Agent, or Firm* — Nixon & Vanderhye PC

(57) ABSTRACT

A spark plug includes a main fitting having a first, second, and third portions adjacent to each other. The spark plug further includes an insulator having a first opposing portion with a predetermined portion opposed to the first portion with a first interval, a second opposing portion with a second portion opposing the second portion with a second interval, and a third opposed portion opposed to the third portion. A connecting portion between the second opposing portion is supported by a support portion, and a value obtained by dividing the first interval by a length from the support portion to a rear end portion of the predetermined portion is configured to be smaller than a value obtained by dividing the second interval by a length from the support portion to a rear end portion of the second opposed portion.

15 Claims, 9 Drawing Sheets

SPARK PLUG AND SEMI-FINISHED PRODUCT THEREOF

CROSS-REFERENCE TO RELATED APPLICATION

This application is based on and claims the benefit of priority from earlier Japanese Patent Application No. 2016-223870 filed Nov. 17, 2016, and No. 2017-129362 filed Jun. 30, 2017, the descriptions of which are incorporated herein by references.

TECHNICAL FIELD

The present disclosure relates to a spark plug and a semi-finished product of the spark plug.

BACKGROUND

An ignition plug is attached to an internal combustion engine, and it is configured that a gas mixture existing in a combustion chamber of the internal combustion engine can be ignited by generating a discharge spark in a spark discharge gap of the ignition plug.

When attaching the ignition plug to the internal combustion engine (a cylinder head thereof), an insulator included in the spark plug may be broken if a bending moment is applied to the insulator.

As a countermeasure to this problem, in a spark plug disclosed in Japanese Patent No. 3711221 (refer to as Patent Document 1), when defining that an outer diameter of an insulator is D at a position corresponding to a leading edge of a terminal metal fitting inserted into a through hole formed in the insulator (an intermediate body portion), and an inner diameter of the through hole in the intermediate body portion is d, the thickness of the intermediate body portion is configured such that $0.42 \leq (D-d)/D \leq 0.79$ is satisfied.

As a result, the durability against bending and impact of the insulator is remarkably improved, so that even when attaching the spark plug to the internal combustion engine, problems such as breakage of the insulator can be made less likely to occur.

Incidentally, a demand for downsizing of the spark plug is increasing in recent years. In order to downsize the spark plug, it is necessary to reduce the diameter of the insulator.

When the diameter of the insulator is reduced, it is difficult to secure the thickness at the intermediate body portion of the insulator, and it is not easy to improve the strength against breakage of the insulator.

SUMMARY

An embodiment provides a spark plug and a semi-finished product of the spark plug capable of improving robustness against breakage of an insulator even when the strength of the insulator itself is not improved.

In a first aspect of a spark plug, the spark plug includes a tubular main fitting, a tubular insulator inserted in the main fitting, and a discharge gap formed on a front end side of the insulator.

The main fitting includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion.

The insulator includes a first opposing portion having a predetermined portion opposed to the first portion at a first interval, a second opposed portion opposed to the second portion at a second interval, and a third opposing portion opposed to the third portion and having an outer diameter smaller than that of the second opposing portion.

The predetermined portion projects in a radially outward direction and is a portion having the largest diameter in the first opposing portion, and a connecting portion between the second opposing portion and the third opposing portion is supported by a support portion which is a connecting portion between the second portion and the third portion.

A value obtained by dividing the first interval by a length from the support portion to a rear end portion of the predetermined portion is configured to be smaller than a value obtained by dividing the second interval by a length from the support portion to a rear end portion of the second opposed portion.

When the spark plug is attached to the internal combustion engine or the like, a load is applied to the insulator, and the insulator sometimes inclines toward the main fitting with the support portion of the main fitting, on which the insulator is supported, as a fulcrum.

In the conventional spark plug, the second opposing portion of the insulator first contacts the main fitting when the insulator is inclined toward the main fitting side.

Then, the insulator is bent with a part where the second opposing portion of the insulator is in contact with the main fitting as a fulcrum, and there is a possibility that problems such as breakage of the insulator may occur.

In preparation for this, the present ignition plug is configured so that the insulator comes into contact with the main fitting on the rear end side of the second portion of the main fitting before the second opposing portion of the insulator comes into contact with the second portion of the main fitting.

That is, a portion on the rear end side of the second part of the main fitting serves as a fulcrum when the insulator is bent.

The predetermined portion opposing the first portion at the first interval is formed in the first opposing portion of the insulator provided in the ignition plug.

Then, the predetermined portion is projected in the radially outward direction and is the portion having the largest diameter in the first opposing portion.

At this time, an arc tangent value (hereinafter referred to as a first arc tangent value), which is a value obtained by dividing a sum of the radius of the rear end portion of the predetermined portion in the insulator and the first interval by the length from the support portion to the rear end portion of the predetermined portion, corresponds to an angle formed by a line connecting a center point of the insulator supported by the support portion and the first portion opposing the rear end portion of the predetermined portion and an axis of the insulator passing through the center point.

Then, an arc tangent value (referred to as a second arc tangent value), which is a value obtained by dividing the radius of the rear end portion of the predetermined portion of the insulator by the length from the support portion to the rear end portion of the predetermined portion, corresponds to an angle formed by a line connecting the center point of the supported insulator and the rear end portion of the predetermined portion and the axis of the insulator passing through the center point.

Therefore, a value obtained by subtracting the first arc tangent value from the second arc tangent value corresponds to an inclination angle necessary for the predetermined portion of the insulator to contact the first portion with the support portion as a fulcrum.

Similarly, the arc tangent value (hereinafter referred to as a third arc tangent value), which is a value obtained by dividing the sum of the radius of the rear end portion of the second opposed portion of the insulator and the second interval by the length from the support portion to the rear end portion of the second opposing portion of the insulator, corresponds to an angle formed by a line connecting the center point of the insulator supported by the support portion and the second portion opposing the rear end portion of the second opposed portion and a line passing through the center point.

Further, an arc tangent value (hereinafter referred to as a fourth arc tangent value), which is a value obtained by dividing the radius of the rear end portion of the second opposed portion of the insulator by the length from the support portion to the rear end portion of the second opposed portion, corresponds to an angle formed by a line connecting the center point of the insulator supported by the support portion and the rear end portion of the second opposed portion and the axis of the insulator passing through the center point.

Therefore, a value obtained by subtracting the third arc tangent value from the fourth arc tangent value corresponds to an inclination angle necessary for the rear end portion of the second opposed portion of the insulator to contact the second portion with the support portion as a fulcrum.

In the present spark plug, the value obtained by dividing the first interval by the length from the support portion to the rear end portion of the predetermined portion is smaller than the value obtained by dividing the second interval by the length from the support portion to the rear end portion of the second opposed portion.

By satisfying this relationship, the value obtained by subtracting the first arc tangent value from the second arc tangent value becomes smaller than the value obtained by subtracting the third arc tangent value from the fourth arc tangent value.

Thereby, the rear end portion of the predetermined portion of the insulator can be brought into contact with the main fitting first when the insulator is inclined toward the main fitting side.

At this time, it is possible to shorten the distance from the force point to the fulcrum as compared with a case where the second opposing part of the insulator contacts the second part of the main fitting, and thus the magnitude of the bending moment acting on the insulator can be made smaller.

As a result, even when the strength of the insulator itself is not improved, robustness against breakage of the insulator can be improved.

In a second aspect of a spark plug, the spark plug includes a tubular main fitting, a tubular insulator inserted in the main fitting, and a discharge gap formed on a front end side of the insulator.

The main fitting includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion.

The insulator includes a first opposing portion having a predetermined portion opposed to the first portion, a second opposed portion opposed to the second portion, and a third opposing portion opposed to the third portion and having an outer diameter smaller than that of the second opposing portion.

The predetermined portion projects in a radially outward direction and is a portion having the largest diameter in the first opposing portion, and a connecting portion between the second opposing portion and the third opposing portion is supported by a support portion which is a connecting portion between the second portion and the third portion.

When defining a first interval as an interval between the first portion and the predetermined portion at a rear end portion of the predetermined portion, and a second interval as an interval between the second portion and the second opposed portion at the rear end portion of the second opposed portion, a value obtained by dividing the first interval by a length from the support portion to the rear end portion of the predetermined portion is configured to be smaller than a value obtained by dividing the second interval by a length from the support portion to the rear end portion of the second opposed portion.

A third interval, which is an interval between the second portion and the second opposing portion at a front end portion of the second opposing portion, is configured to be smaller than the first interval.

According to the above configuration, it is possible to obtain the same function and effect as the first aspect.

Furthermore, since the third interval is smaller than the first interval, it is possible to suppress the positions of the main fitting and the insulator from being displaced (relative movement) at the front end portion of the second opposed portion.

As a result, it is possible to prevent the center axis of the main fitting and the center axis of the insulator from deviating at the front end portion of the second opposed portion, thereby is possible to prevent the insulator from inclining with respect to the main fitting when the load is applied to the insulator, and eventually prevent the insulator from breaking.

In a third aspect of a spark plug, the spark plug includes a tubular main fitting, a tubular insulator inserted in the main fitting, and a discharge gap formed on a front end side of the insulator.

A semi-finished product of the spark plug is a spark plug in a state before the main fitting is crimped to the insulator, and the main fitting of the semi-finished product of the spark plug includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion.

The insulator includes a first opposing portion having a predetermined portion opposed to the first portion at a first interval, a second opposed portion opposed to the second portion at a second interval, and a third opposing portion opposed to the third portion and having an outer diameter smaller than that of the second opposing portion.

The first portion includes a thin wall portion having a smaller thickness in a radial direction than other portions of the first portion in the main fitting, and the predetermined portion projects in a radially outward direction and is a portion having the largest diameter in the first opposing portion.

A rear end portion of the predetermined portion is within a range of the thin wall portion in an axial direction, and a connecting portion between the second opposing portion and the third opposing portion is supported by a support portion which is a connecting portion between the second portion and the third portion.

A value obtained by dividing the first interval by a length from the support portion to a rear end portion of the predetermined portion is configured to be smaller than a value obtained by dividing the second interval by a length from the support portion to a rear end portion of the second opposed portion.

DETAILED DESCRIPTION OF THE PREFERRED EMBODIMENT

First Embodiment

Figure 1:
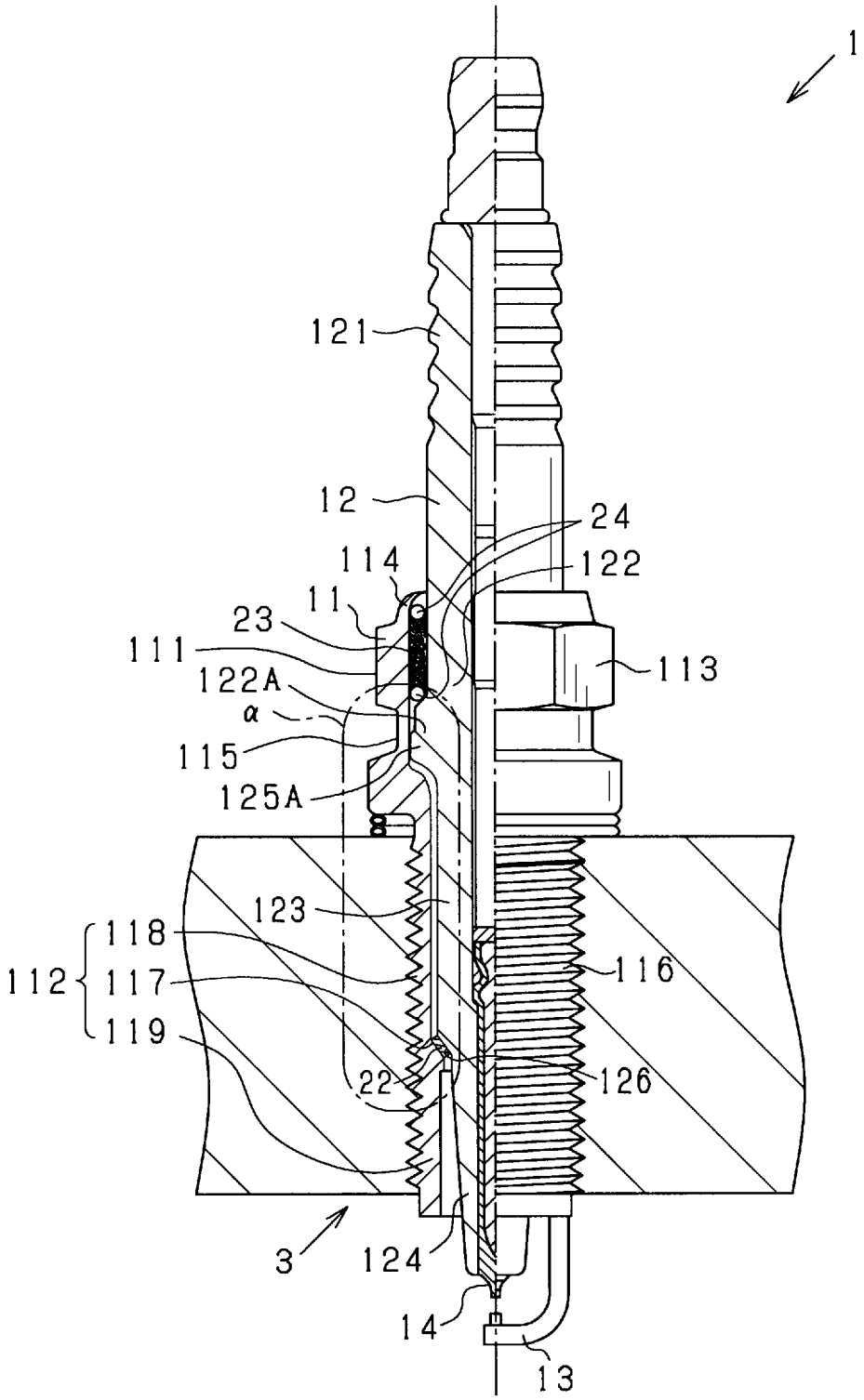
FIG. 1 shows a half sectional view of a spark plug according to a first embodiment.

FIG. 1 shows a half sectional view of a spark plug 1 attached to an internal combustion engine.

The spark plug 1 includes a substantially cylindrical metal-made main fitting 11, a substantially cylindrical insulator 12 held on an inner circumferential surface of the main fitting 11, a substantially cylindrical center electrode 14 held on an inner circumferential surface of the insulator 12, and a ground electrode 13 that protrudes toward a combustion chamber 3 side (referred to as a front end side) of the main fitting 11 and is disposed so as to face a front end side of the center electrode 14 with a predetermined discharge gap therebetween.

The main fitting 11 has a base portion 111 (corresponding to a first portion) formed on a side (referred to as a rear end side) opposite to the ground electrode 13 of the main fitting 11, and a front end portion 112 having a smaller diameter than the base portion 111 on the front end side of the base portion 111

A tool engaging portion 113 having a hexagonal outer periphery for engaging a plug wrench 21 (refer to FIG. 3) used for attaching the main fitting 11 to an internal combustion engine or the like is disposed on an outer peripheral portion of the base portion 111.

Although an interval between opposing surfaces of the tool engaging portion 113 is set to 14 mm in the present embodiment, it may be set smaller than 14 mm.

A crimping portion 114 for holding the insulator 12 is formed on a rear end portion of the tool engaging portion 113.

A thin wall portion 115 having a smaller thickness in a radially inward direction than those of other portions of the base portion 111 is disposed on the front end side of the tool engagement portion 113 so as to be adjacent to the tool engagement portion 113.

A threaded portion (a male thread portion) 116 as a mounting portion for attaching the spark plug 1 to the internal combustion engine is formed on an outer peripheral portion of the front end portion 112.

Although a nominal diameter of the threaded portion 116 is set to M12 in the present embodiment, the nominal diameter of the threaded portion 116 may be set smaller than M12.

A support portion 117 is formed in an inner peripheral portion of the front end portion 112 so that an inner diameter of the support portion 117 becomes smaller toward the front end side in order to support the insulator 12.

The front end portion 112 is divided into a rear-front end portion 118 (corresponding to a second portion) disposed on a rear end side of the support portion 117, and into a front-front end portion 119 (corresponding to a third portion) disposed on a front end side of the support portion 117 in the present embodiment.

In other words, the front end portion 112 is composed of the support portion 117, the rear-front end portion 118, and the front-front end portion 119, and the rear-front end portion 118 is connected to the front-front end portion 119 via the support portion 117.

The insulator 12 is inserted into the main fitting 11. The insulator 12 includes a rear end side body part 121, a large-diameter portion 122 (corresponding to a first opposed portion), an intermediate body portion 123 (corresponding to a second opposed portion), and a long leg portion 124 (corresponding to a third opposed portion).

The rear end side body part 121 formed on the rear end side of the insulator 12.

The large-diameter portion 122 has a projecting part 122A formed so as to protrude in a radially outward direction on a front end side from the rear end side body part 121 of the insulator 12.

The intermediate body portion 123 has a diameter smaller than that of the large-diameter portion 122 on a front end side from the large-diameter portion 122 of the insulator 12.

The long leg portion 124 has a diameter smaller than that of the intermediate body portion 123 on a front end side from the intermediate body portion 123 of the insulator 12.

That is, an outer diameter of the long leg portion 124 is smaller than an outer diameter of the intermediate body portion 123.

Figure 4:
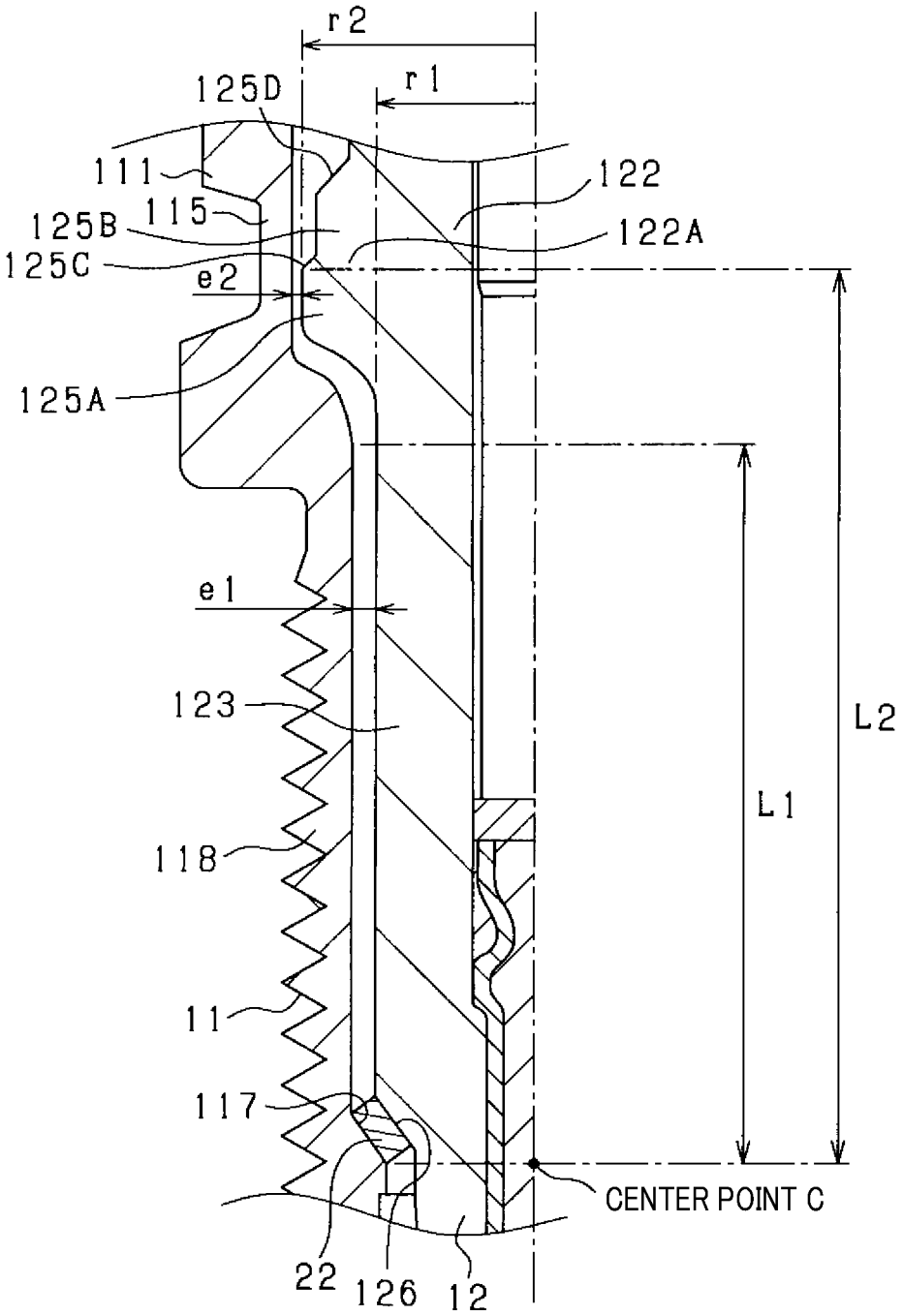
FIG. 4 shows an enlarged view of a principal part a in FIG. 1.

As shown in FIG. 4, the projecting part 122A has a maximum diameter portion 125A (corresponding to a predetermined portion) having the largest diameter in the large-diameter portion 122, and a small diameter portion 125B having a smaller diameter than the maximum diameter portion 125A.

Then, a first inclined portion 125C inclined toward the rear end side in the radial direction is formed in a connecting portion between the maximum diameter portion 125A and the small diameter portion 125B.

Further, a second inclined portion 125D inclined toward the rear end side in the radial direction is formed in a connecting portion between the maximum diameter portion 125A and the rear end side body portion 121.

In the insulator 12, a glaze is applied to a rear end side of the second inclined portion 125D and the glaze is not applied to a front end side of the maximum diameter portion 125A.

At this time, the glaze applied at the rear end side of the second inclined portion 125D tries to flow toward the front end side of the insulator 12, however, the flowing glaze will be stopped by the first inclined portion 125C and the second inclined portion 125D.

That is, the first inclined portion 125C and the second inclined portion 125D have a damming function of the glaze.

The maximum diameter portion 125A is configured to oppose the base portion 111 with an interval e2 (corresponding to a first interval) therebetween.

Further, the intermediate body portion 123 is configured to oppose the rear-front end portion 118 with an interval e1 (corresponding to a second interval) therebetween.

An insulator-side tapered portion 126 inclining toward the rear end side in the radially outward direction is formed at a connecting portion between the intermediate body portion 123 and the long leg portion 124, and the insulator-side tapered portion 126 is supported by the support portion 117 of the main fitting 11 via an annular plate packing 22.

Returning to the description of FIG. 1, annular seal members 24 are accommodated between the base portion 111 of the main fitting 11 and the rear end side body portion 121 of the insulator 12, and between the base portion 111 of the main fitting 11 and the large-diameter portion 122 of the insulator 12, and talc (talcum) powder 23 is filled between the seal members 24.

Therefore, the main fitting 11 supports the insulator 12 via the plate packing 22 and the seal members 24.

The insulator 12 is inserted into the main fitting 11 from the rear end side toward the front end side in a process of manufacturing the ignition plug 1.

Figure 2:
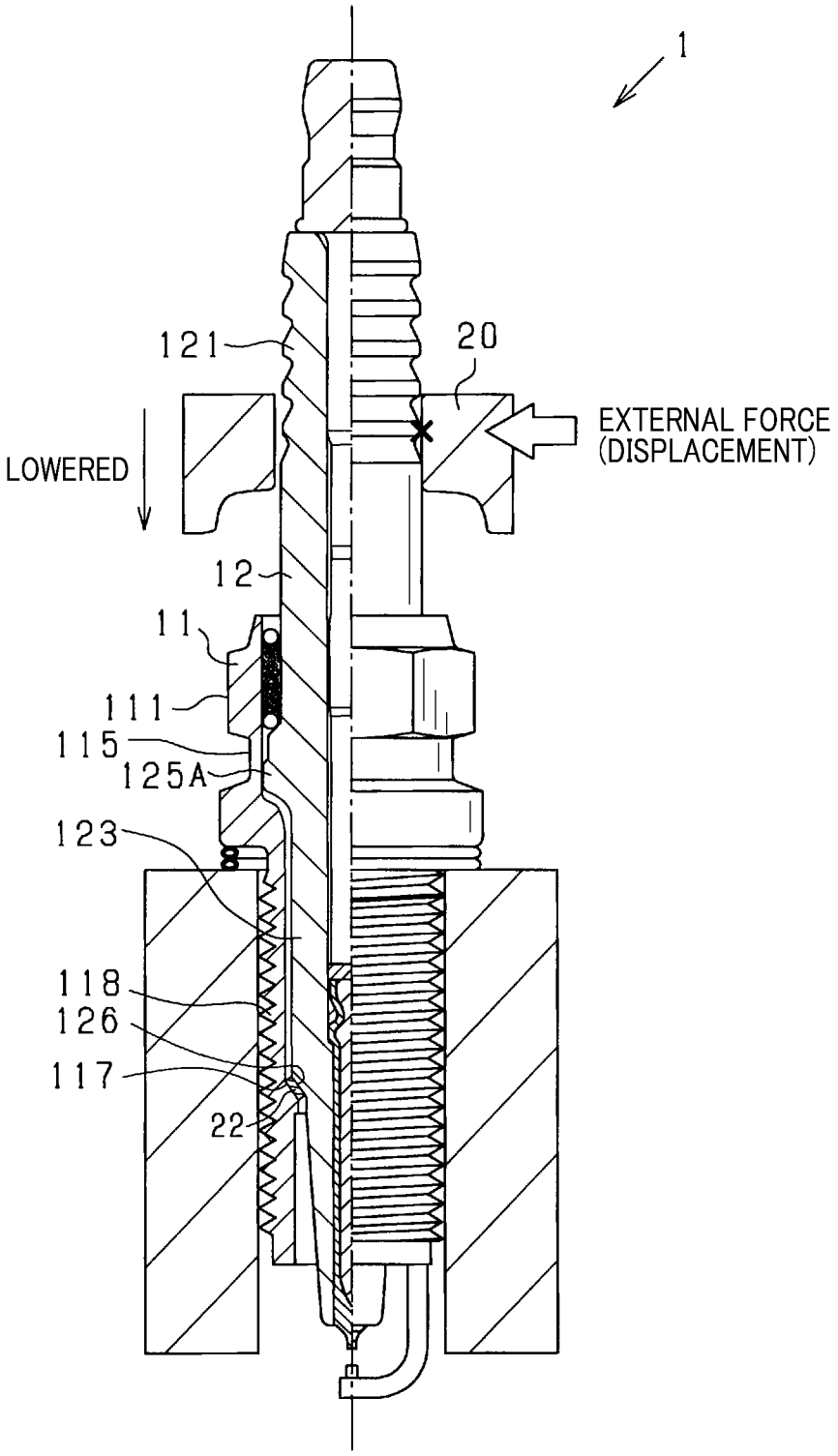
FIG. 2 shows a schematic view of how an insulator is crimped to a main fitting using a crimping jig.

Then, in a state where the insulator-side tapered portion 126 of the insulator 12 is supported by the support portion 117 of the main fitting 11 via the plate packing 22, the rear end portion of the base portion 111 is crimped radially inward by using a crimping jig 20 (see FIG. 2).

Thereby, a crimped portion 114 is formed, and the insulator 12 is fixed to the main fitting 11.

Incidentally, as shown in FIG. 2, when the crimping jig 20 is lowered toward the rear end portion of the base portion 111, the crimping jig 20 comes into contact with the rear end side body portion 121 of the insulator 12, so that the insulator 12 may incline with the support portion 117 of the main fitting 11 as a fulcrum.

Figure 3:
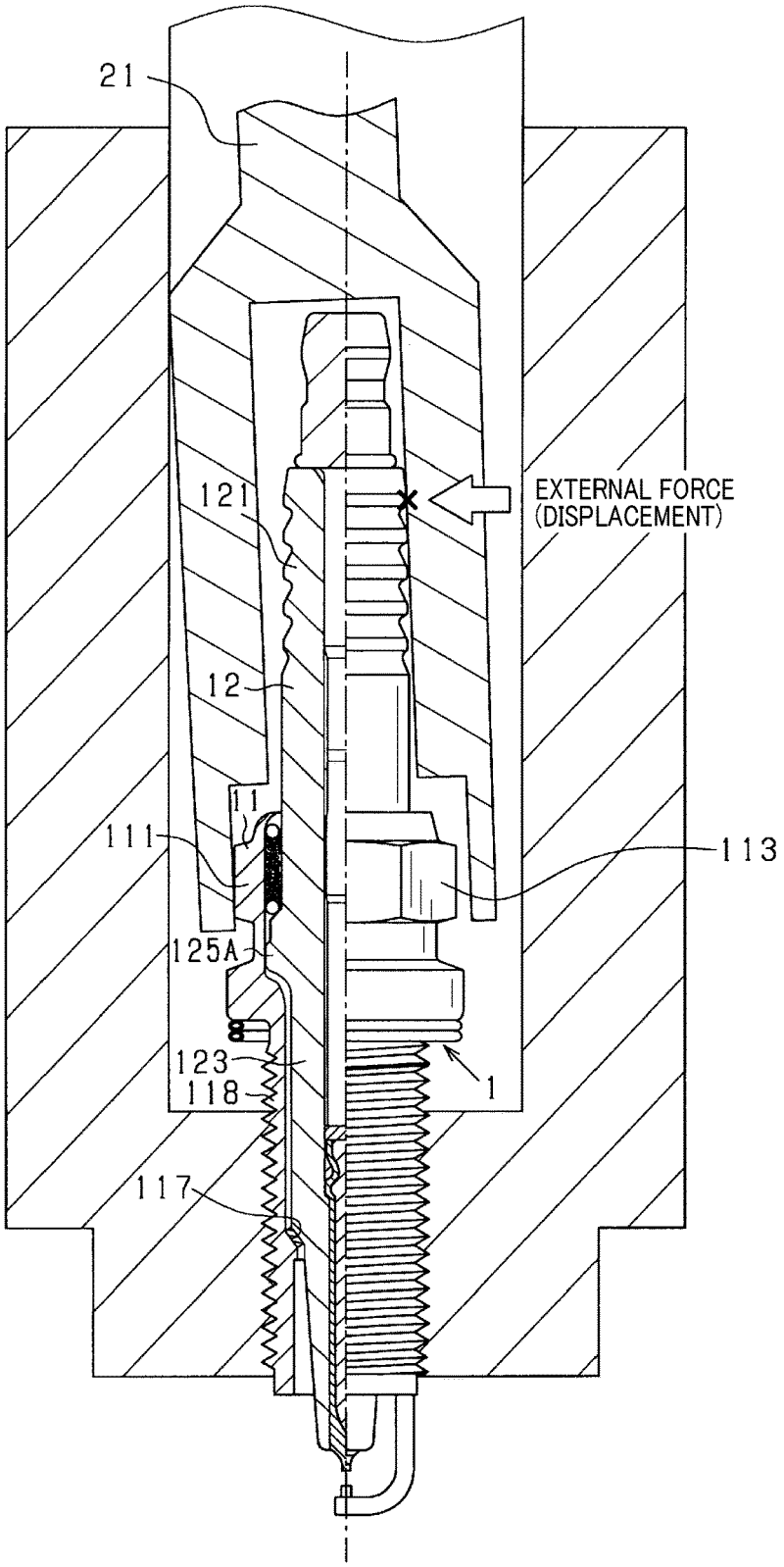
FIG. 3 shows a schematic view of a state in which the spark plug is attached to an internal combustion engine using a plug wrench.

Alternatively, as shown in FIG. 3, when the spark plug 1 is attached to the internal combustion engine using the plug wrench 21 engageable with the outer periphery of the tool engaging portion 113, the plug wrench 21 comes into contact with the rear end side body portion 121 of the insulator 12, so that the insulator 12 may incline with the support portion 117 of the main fitting 11 as a fulcrum.

The intermediate body portion 123 of the insulator 12 first contacts the main fitting 11 when the insulator 12 is inclined toward the main fitting 11 side in the conventional spark plug.

Then, the insulator 12 is bent with a part where the intermediate body portion 123 of the insulator 12 is in contact with the main fitting 11 as a fulcrum, and there is a possibility that problems such as breakage of the insulator 12 may occur.

In preparation for this, the present spark plug 1 is configured so that the insulator 12 comes into contact with the main fitting 11 on the rear end side of the rear-front end portion 118 of the main fitting 11 before the intermediate body portion 123 of the insulator 12 comes into contact with the main fitting 11.

More specifically, the present spark plug 1 is configured so that the maximum diameter portion 125A of the insulator 12 comes into contact with the base portion 111 of the main fitting 11 before the intermediate body portion 123 of the insulator 12 comes into contact with the main fitting 11.

As a result, a part where the maximum diameter portion 125A of the insulator 12 is in contact with the base portion 111 of the main fitting 11 serves as a fulcrum when the insulator 12 is bent.

The spark plug 1 is configured to meet a relationship described below so that the maximum diameter portion 125A of the insulator 12 comes into contact with the base part 111 of the main fitting 11 before the intermediate body portion 123 of the insulator 12 comes into contact with the main fitting 11.

As shown in FIG. 4, a length from the front end portion of the support portion 117 to the rear end portion of the interval e1 in an axial direction of the main fitting 11 is defined as a length L1.

Moreover, a length from the front end portion of the support portion 117 of the main fitting 11 to the rear end portion of the maximum diameter portion 125A of the insulator 12 in the axial direction is defined as a length L2.

Further, a radius of the intermediate body portion 123 of the insulator 12 is defined as a radius r1, and a radius of the maximum diameter portion 125A is defined as a radius r2.

At this time, an arc tangent value (hereinafter referred to as a first arc tangent value), which is a value obtained by dividing the sum of the radius r2 and the interval e2 by the length L2, corresponds to an angle formed by a line connecting a center point C of the insulator 12 and a position of the base portion 111 opposing the rear end portion of the maximum diameter portion 125A at a position opposing the front end portion of the support portion 117 and an axis of the insulator 12 passing through the center point C.

An arc tangent value (referred to as a second arc tangent value), which is a value obtained by dividing the radius r2 by the length L2, corresponds to an angle formed by a line connecting the center point C of the insulator 12 and the rear end portion of the maximum diameter portion 125A at a position opposing the front end portion of the support portion 117 and the axis of the insulator 12 passing through the center point C.

Therefore, a value obtained by subtracting the first arc tangent value from the second arc tangent value corresponds to an inclination angle (rotation angle) necessary for the maximum diameter portion 125A of the insulator 12 to contact with the base portion 111 of the main fitting 11 when the insulator 12 is tilted with the support portion 117 as a fulcrum.

Similarly, an arc tangent value (hereinafter referred to as a third arc tangent value), which is a value obtained by dividing the sum of the radius r1 and the interval e1 by the length L1, corresponds to an angle formed by a line connecting the center point C of the insulator 12 and a position of the rear-front end portion 118 opposing the rear end portion of the intermediate body portion 123 of the insulator 12 at a position opposing the front end portion of the support portion 117 and the axis of the insulator 12 passing through the center point C.

Further, an arc tangent value (hereinafter referred to as a fourth arc tangent value), which is a value obtained by dividing the radius r1 by the length L1, corresponds to an angle formed by a line connecting the center point C of the insulator 12 and a position of the rear-front end portion 118 opposing the rear end portion of the intermediate body portion 123 of the insulator 12 at a position opposing the front end portion of the support portion 117 and the axis of the insulator 12 passing through the center point C.

Therefore, a value obtained by subtracting the third arc tangent value from the fourth arc tangent value corresponds to the angle of inclination (rotation angle) necessary for the rear end portion of the intermediate body portion 123 of the insulator 12 to contact with the rear-end portion 118 of the main fitting 11 when the insulator 12 is tilted with the support portion 117 as a fulcrum.

That is, in order for the maximum diameter portion 125A of the insulator 12 to come into contact with the base portion 111 of the main fitting 11 prior to the rear end portion of the intermediate body portion 123 of the insulator 12 contacting the rear-front end portion 118 of the main fitting 11, it may be configured to satisfy the relationship of the following expression.

More specifically, it may be configured so that the value obtained by subtracting the second arc tangent value from the first arc tangent value is smaller than the value obtained by subtracting the fourth arc tangent value from the third arc tangent value.

$$\arctan\{(r2+e2)/L2\}-\arctan(r2/L2)<\arctan\{(r1+e1)/L1\}-\arctan(r1/L1)$$

At this time, the expression can be transformed into the following expression (2).

That is, if the relationship that the value obtained by dividing the interval e2 by the length L2 is smaller than the value obtained by dividing the interval e1 by the length L1, the relationship represented by the expression can be satisfied.

$$e2/L2<e1/L1 \quad (2)$$

In the present spark plug 1, the length L2 is longer than the length L1 and the interval e2 is narrower than the interval e1.

As a result, since it is possible to satisfy the relationship represented by the expression (2) the maximum diameter portion 125A of the insulator 12 can be brought into contact with the base portion 111 of the main fitting 11 before the intermediate body portion 123 of the insulator 12 comes into contact with the main fitting 11.

Incidentally, in the present spark plug 1, the rear end portion of the maximum diameter portion 125A is configured to be within a range in the axial direction of the thin wall portion 115 of the main fitting 11.

In the present semi-finished product of the spark plug 1 before the insulator 12 is crimped to the main fitting 11 by the crimping jig 20, the rear end portion of the maximum diameter portion 125A is configured already to be within the range in the axial direction of the thin wall portion 115 of the main fitting 11.

Figure 5:
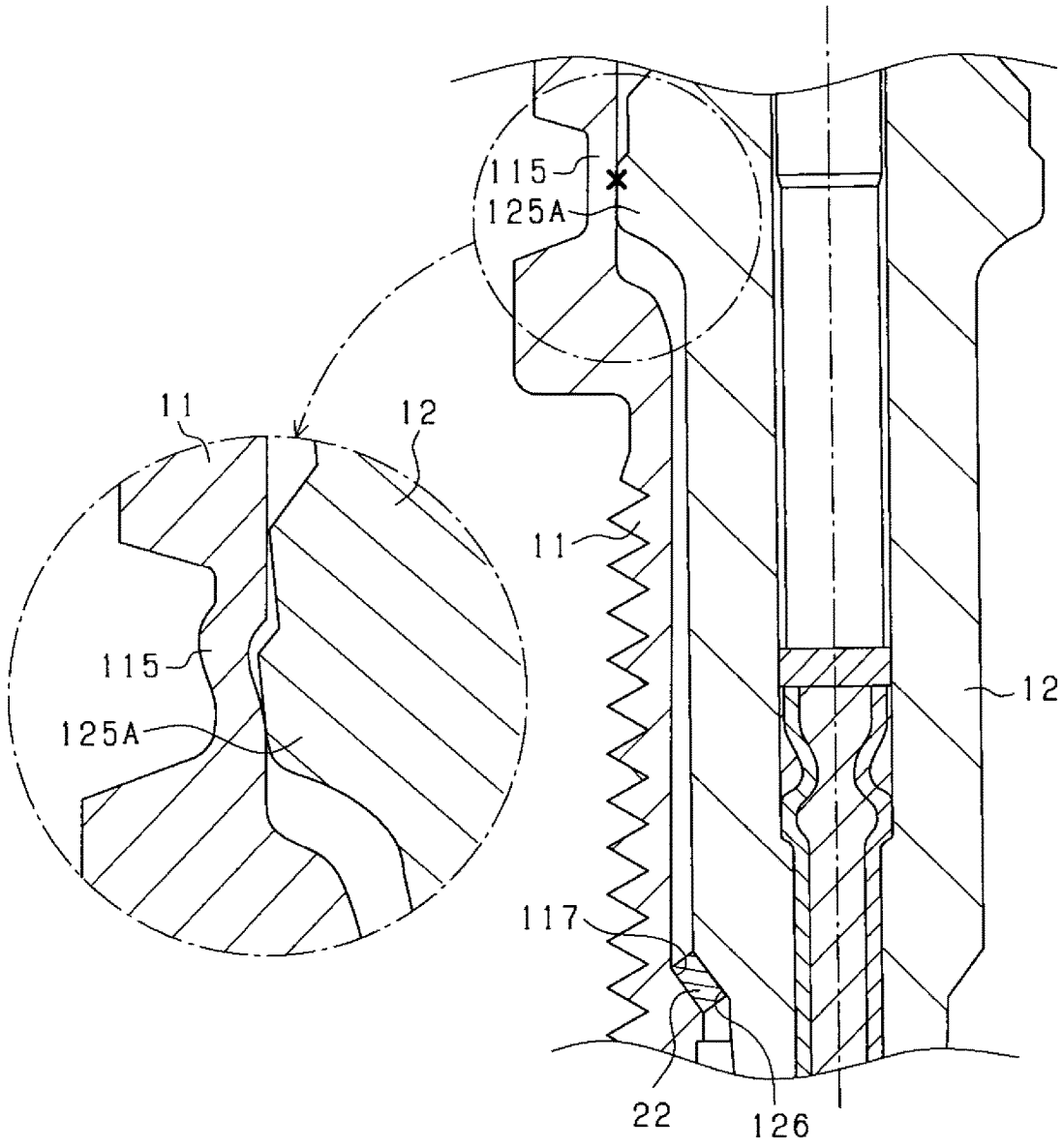
FIG. 5 shows a schematic view of a state where the insulator is in contact with a thin wall portion of the main fitting.

Therefore, when the insulator 12 is crimped by the crimping jig 20 after the insulator 12 is inserted into the main fitting 11, the insulator 12 inclines with the support portion 117 of the main fitting 11 (or the center point C) as a fulcrum as shown in FIG. 5, the maximum diameter portion 125A of the insulator 12 comes into contact with the thin wall portion 115 of the main fitting 11.

Since the thin wall portion 115 of the main fitting 11 is thinner than other portions of the base portion 111, the thin wall portion 115 will be deformed when the maximum diameter portion 125A of the insulator 12 contacts the thin wall portion 115 of the main fitting 11.

As a result, a displaceable amount of the insulator 12 increases by an amount corresponding to the deformation of the thin wall portion 115, and it is possible to suppress the load from acting on the insulator 12.

The present embodiment has the following effects with the above configuration.

According to the above configuration, the spark plug 1 has the length L2 longer than the length L1 and the interval e2 narrower than the interval e1, thereby satisfying the relationship of the expression (2), and eventually it satisfies the relationship of the expression.

Accordingly, the rear end portion of the maximum diameter portion 125A can be brought into contact with the main fitting 11 first when the insulator 12 is inclined toward the main fitting 11 side.

Figure 6:
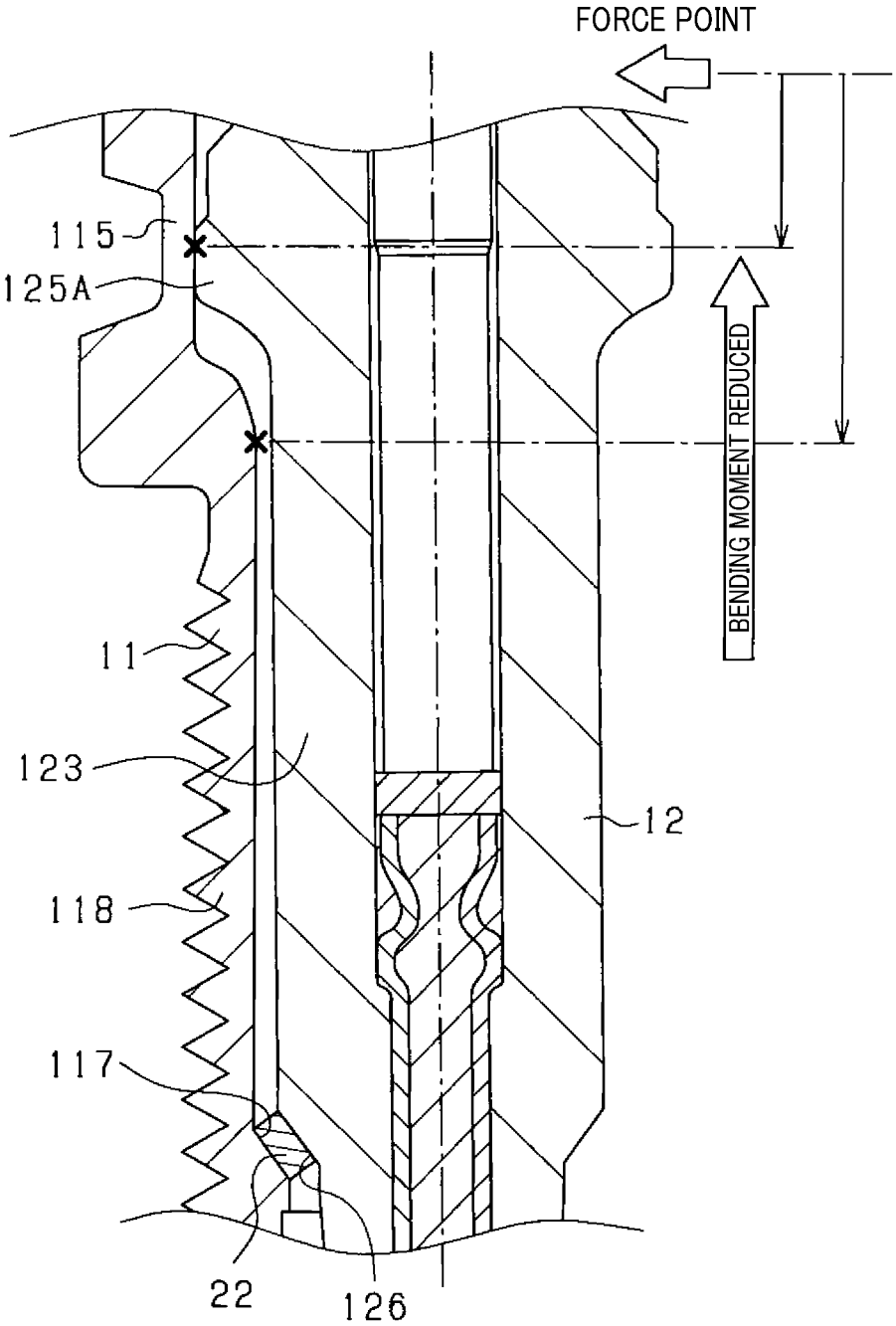
FIG. 6 shows a schematic diagram of how a distance from a force point to a fulcrum varies between when the insulator contacts the thin wall portion of the main fitting and when the insulator contacts a rear end portion of the main fitting.

At this time, as shown in FIG. 6, the distance from the force point to the fulcrum can be made shorter than in a case where the intermediate body portion 123 of the insulator 12 contacts the rear-front end portion 118 of the main fitting 11, thereby a magnitude of the load (bending moment) acting on the insulator 12 can be reduced.

In addition, since the rear end portion of the maximum diameter portion 125A is configured to contact the thin wall portion 115 of the main fitting 11 when the insulator 12 is inclined toward the main fitting 11 side, the displacement amount of the insulator 12 can be increased.

Therefore, it is possible to further reduce the magnitude of the load acting on the insulator 12.

Figure 7:
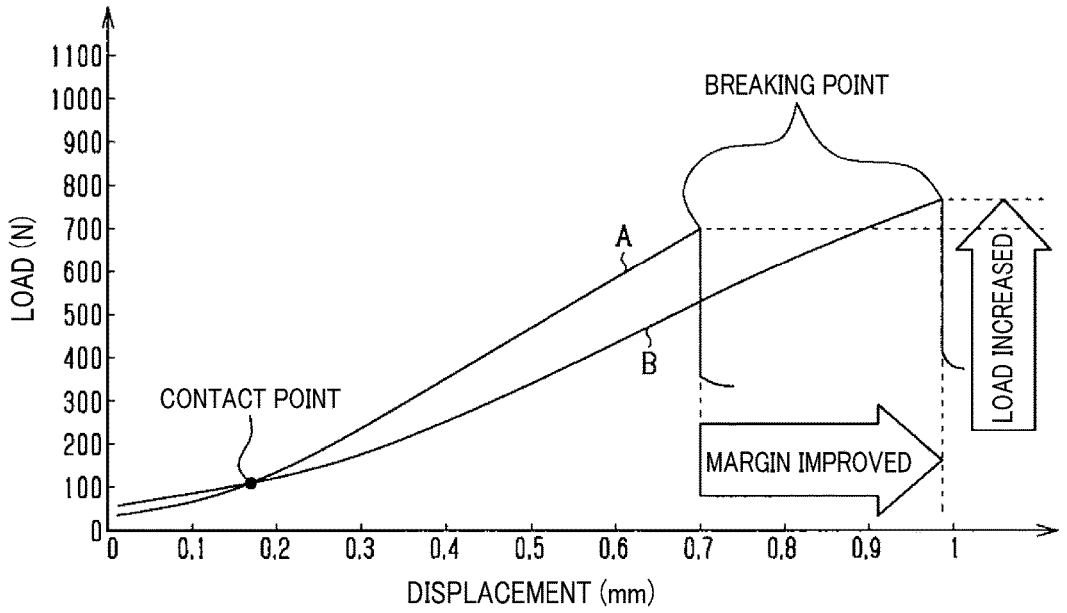
FIG. 7 shows a graph of how a relationship between load acting on the insulator and a displacement amount varies between when the insulator contacts the thin wall portion of the main fitting and when the insulator contacts the rear end portion of the main fitting during crimping.
Figure 8:
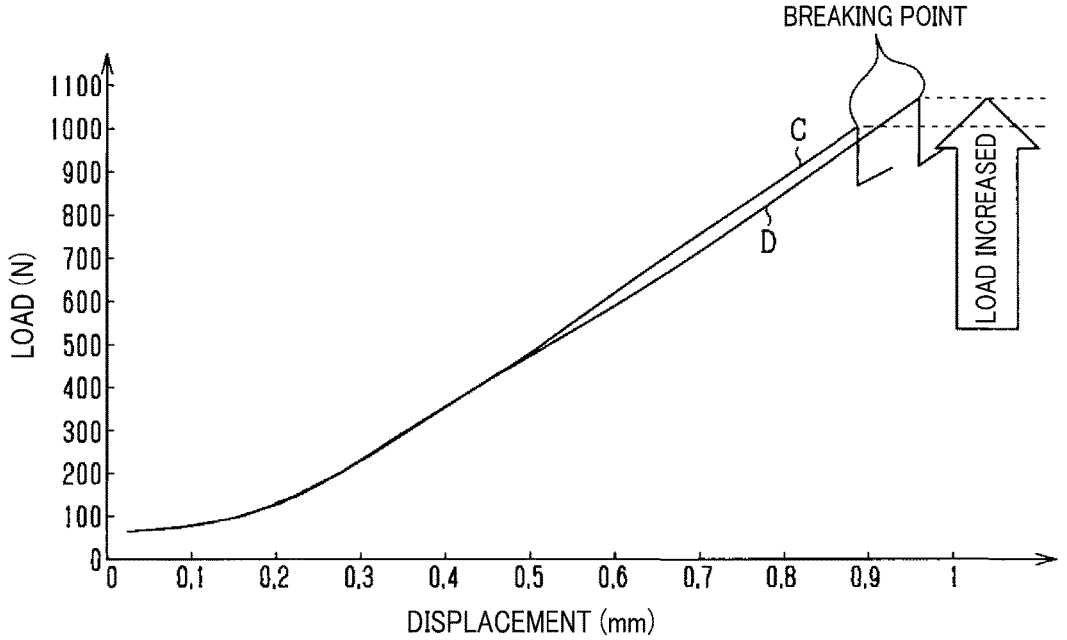
FIG. 8 shows a graph of how a relationship between load acting on the insulator and a displacement amount varies between when the insulator contacts the thin wall portion of the main fitting and when the insulator contacts the rear end portion of the main fitting when the spark plug is attached to the internal combustion engine.

It is shown in FIGS. 7 and 8 that the magnitude of the load acting on the insulator 12 could be actually reduced.

In FIG. 7, two graphs showing how much the amount of displacement of the insulator 12 has changed with an increase in the load acting on the insulator 12 when the insulator 12 is crimped to the main fitting 11 by the crimping jig 20 and the crimping jig 20 contacts the insulator 12, whereby the insulator 12 comes in contact with the main fitting 11.

The graph A shows a case where the intermediate body portion 123 of the insulator 12 first contacts the rear-front end portion 118 of the main fitting 11.

The graph B shows a case where the maximum diameter portion 125A of the insulator 12 first contacts the thin wall portion 115 of the main fitting 11.

Assuming that an intersection at which the two graphs A and B intersected is a contact point where the insulator 12 contacts the main fitting 11, an amount of displacement with respect to the load was larger in graph B than the graph A after the contact point.

Further, in graph B, compared with graph A, a maximum displacement amount of the insulator 12 can be increased, and additionally, an upper limit of the load allowable until the spark plug 1 is broken can be increased.

In FIG. 8, two graphs showing how much the amount of displacement of the insulator 12 has changed with an increase in the load acting on the insulator 12 when the spark plug 1 is attached to the internal combustion engine using the plug wrench 21 and the plug wrench 21 contacts the insulator 12, whereby the insulator 12 comes in contact with the main fitting 11.

The graph C shows a case where the intermediate body portion 123 of the insulator 12 first contacts the rear-front end portion 118 of the main fitting 11.

The graph D shows a case where the maximum diameter portion 125A of the insulator 12 contacts the thin wall portion 115 of the main fitting 11.

A process of attaching the spark plug 1 to the internal combustion engine using the plug wrench 21 (hereinafter referred to as an attaching process) is performed after a process of crimping the insulator 12 to the main fitting 11 by the crimping jig 20 (hereinafter referred to as a crimping process).

Therefore, it is considered that the thin wall portion 115 of the main fitting 11 has already been plastically deformed during the attaching process.

Therefore, as compared with FIG. 7, there was no significant difference between the graph C and the graph D as to the magnitude of the displacement amount of the insulator 12 with respect to the load acting on the insulator 12.

However, since a contact position when the insulator 12 is brought into contact with the main fitting 11 by being inclined becomes the rear end side of the spark plug 1 according to the graph B as compared with the spark plug according to the graph A, an upper limit of the load allowable until the spark plug 1 is broken can be increased.

Usually the crimping process is mainly performed by a machine, so that it is expected that a large load acts on the insulator 12 via the crimping jig 20 that is in contact therewith.

On the other hand, since the attaching process is mainly performed by hand, it is possible to adjust the load applied to the insulator 12 via the contacting plug wrench 21.

That is, it is assumed that the load acting on the insulator 12 via the plug wrench 21 during the attaching process is smaller than the load acting on the insulator 12 via the crimping jig 20 during the crimping process.

Therefore, it can be said that the effect shown in FIG. 8 that the upper limit of the load allowable until the spark plug 1 is broken can be increased is a sufficient effect to avoid the insulator 12 from being broken during the attaching process.

As described above, even when the strength of the insulator 12 itself is not increased, it is possible to improve the robustness against the breakage of the insulator 12 by adopting the present configuration.

The length in the axial direction of the maximum diameter portion 125A is shorter as compared with a configuration in which the entire projecting part 122A to be the maximum diameter portion 125A (described later as another example).

Therefore, the length in the axial direction of the thin wall portion 115 formed in the main fitting 11 can be configured to be shorter than the configuration in which the entire projecting part 122A is the maximum diameter portion 125A.

As a result, it is possible to shorten in the axial direction a portion where the strength decreases (i.e., the thin wall portion 115) in the main fitting 11, and it is possible to obtain the strength of the entire main fitting 11.

It is particularly preferable to adopt the present configuration in order to downsize the ignition plug 1.

More specifically, it is preferable to adopt the present configuration to a spark plug 1 having the nominal diameter of the threaded portion 116 formed in the main fitting 11 is M12 or less, or to a spark plug 1 having an interval between the opposing surfaces of the tool engaging portion 113 having a hexagonal outer periphery is 14 mm or less.

It should be noted that the above embodiment may be modified as follows.

The interval between the opposing surfaces of the tool engaging portion 113 is configured to be 14 mm or less in the above embodiment.

However, the interval between the opposing surfaces of the tool engaging portion 113 may be configured to be larger than 14 mm.

The outer periphery of the tool engaging portion 113 is formed in a hexagonal shape in the above embodiment.

However, it is not limited to a hexagonal shape, and it may be formed in a dodecagonal shape, for example.

The nominal diameter of the threaded portion 116 is set to M12 or less in the above embodiment.

However, the nominal diameter of the threaded portion 116 may be configured larger than M12.

In the above embodiment, the spark plug 1 is constructed so that the expressions and (2) are satisfied based on defining that the length from the front end portion of the support portion 117 to the rear end portion of the interval e1 in the axial direction of the main fitting 11 is the length L1, and the length from the front end portion of the support portion 117 of the main fitting 11 to the rear end portion of the maximum diameter portion 125A of the insulator 12 is the length L2.

However, there is no need to set a reference position of the support portion 117 of the main fitting 11 as the front end portion, and for example, a reference position of the support portion 117 of the main fitting 11 may be the rear end portion.

More specifically, a length from the rear end portion of the support portion 117 to the rear end portion of the interval e1 in the axial direction may be defined as the length L1 and a length from the rear end portion of the support portion 117 of the main fitting 11 to the rear end portion of the maximum diameter portion 125A of the insulator 12 in the axial direction may be defined as a length L2.

The protruding portion 122A is provided with the maximum diameter portion 125A, the small diameter portion 125B, the first inclined portion 125C, and the second inclined portion 125D in the above embodiment.

However, the protruding portion 122A may be configured to have the largest diameter in the large-diameter portions 122.

That is, the entire projecting part 122A may be configured to be the maximum diameter portion 125A without providing the small diameter portion 125B, the first inclined portion 125C, and the second inclined portion 125D.

In the above embodiment, the spark plug 1 was configured such that the rear end portion of the maximum diameter portion 125A is within the range in the axial direction of the thin wall portion 115 of the main fitting 11.

However, the configuration of the spark plug 1 before the insulator 12 is crimped to the main fitting 11 is such that the rear end portion of the maximum diameter portion 125A may be located outside the range in the axial direction of the thin wall portion 115 of the main fitting 11 after being crimped as long as the rear end portion of the largest diameter portion 125A is configured to fit within the range in the axial direction of the thin wall portion 115 of the main fitting 11.

The semi-finished product of the spark plug 1 before the insulator 12 is crimped to the main fitting 11 was configured such that the rear end portion of the largest diameter portion 125A fits within the range in the axial direction of the thin wall portion 115 of the main fitting 11 in the above embodiment.

However, instead of having the rear end portion of the maximum diameter portion 125A fit within the range in the axial direction of the thin wall portion 115 of the main fitting 11, it may be configured such that the front end portion of the maximum diameter portion 125A fits within the range of the thin wall portion 115, for example.

The semi-finished product of the spark plug 1 before the insulator 12 is crimped to the main fitting 11 in the above embodiment is configured such that the rear end portion of the maximum diameter portion 125A fits within the range in the axial direction of the thin wall portion 115 of the main fitting 11 in order to bring the maximum diameter portion 125A of the insulator 12 into contact with the thin wall portion 115 of the main fitting 11.

However, it is not always necessary to bring the maximum diameter portion 125A of the insulator 12 into contact with the thin wall portion 115 of the main fitting 11.

Therefore, the semi-finished product of the spark plug 1 before the insulator 12 is crimped to the main fitting 11 may be configured so that the maximum diameter portion 125A is located outside the range in the axial direction of the thin wall portion 115 of the main fitting 11.

The interval e2 is configured to be narrower than the interval e1 in the above embodiment. However, as long as the expression is satisfied, the interval e2 may be configured wider than the interval e1.

Second Embodiment

In the second embodiment, a shape of the intermediate body portion 123 (the second opposing portion) in the insulator 12 of the first embodiment is changed. Other configurations are the same as those in the first embodiment.

It should be appreciated that, in the second embodiment, components identical with or similar to those in the first embodiment are given the same reference numerals, unless otherwise indicated, and repeated structures and features thereof will not be described in order to avoid redundant explanation.

Figure 9:
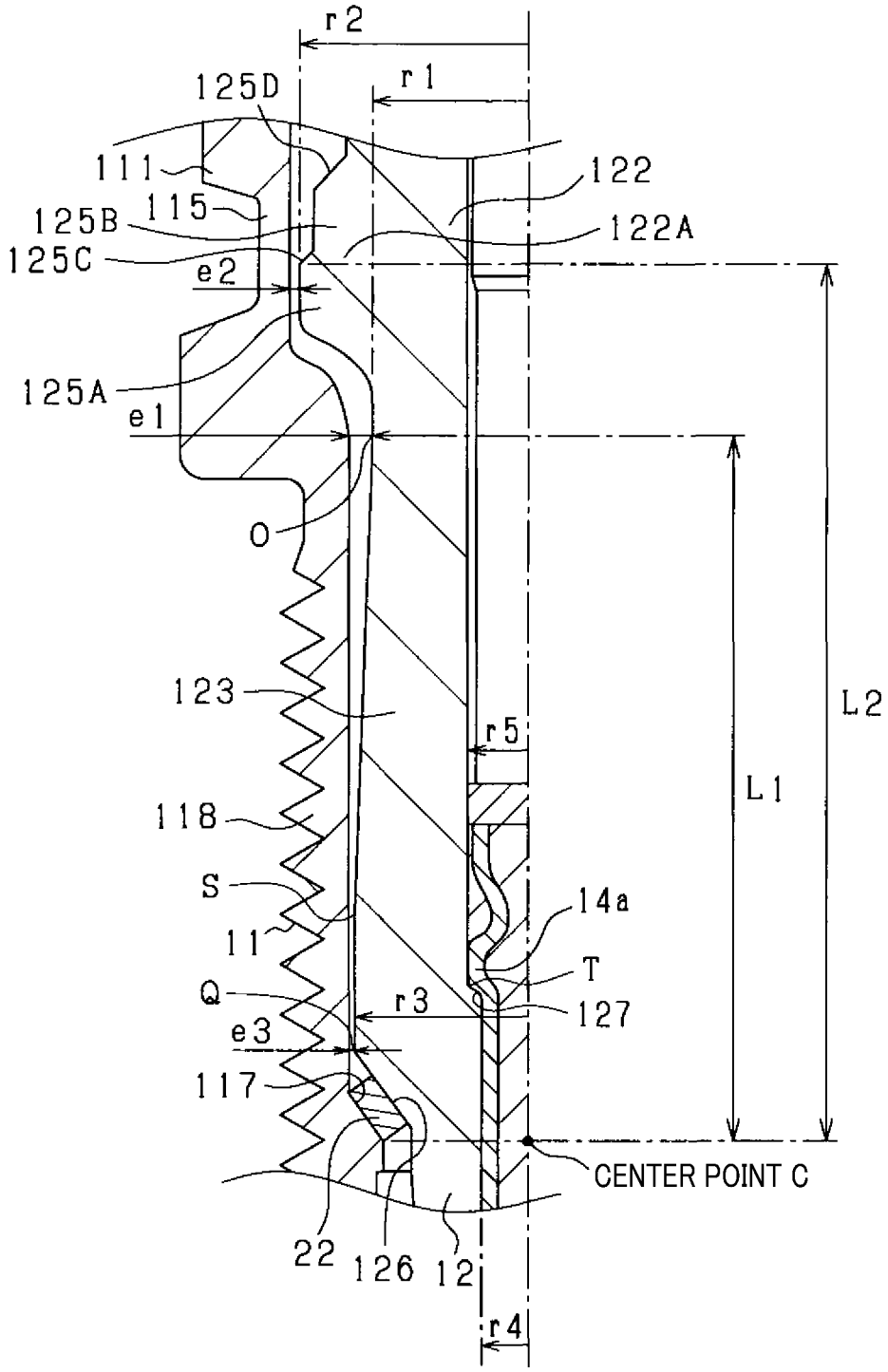
FIG. 9 shows another enlarged view of a principal part a in FIG. 1.

As shown in FIG. 9, an outer diameter of an intermediate body portion 123 of an insulator 12 increases toward the front end side in the present embodiment.

That is, a radius r3 (outer diameter) at a front end Q of the intermediate body portion 123 is larger than a radius r1 (outer diameter) at a rear end O of the intermediate body portion 123.

As a result, a distance e3 (corresponding to a third distance) between the rear-front end portion 118 (the second portion) and the intermediate body portion 123 at the front end Q of the intermediate body portion 123 is smaller than a distance e1 (corresponding to a second interval) between the rear-front end portion 118 and the intermediate body portion 123 at the rear end O of the intermediate body portion 123.

Then, the interval e3 is smaller than an interval e2 (corresponding to a first interval) between a base portion 111 (a first portion) at a rear end portion of a maximum diameter portion 125A (a predetermined portion) and the maximum diameter portion 125A (e1>e2>e3).

Further, an interval between the rear-front end portion 118 and the intermediate body portion 123 is constant at an interval e3 from the front end portion Q of the intermediate body portion 123 to a first predetermined position S on the rear end side.

Here, in the intermediate body portion 123, a radius r4 (an inner diameter) on the front end side from a second predetermined position T is smaller than a radius r5 (an inner diameter) on the rear end side from the second predetermined position T.

That is, a tapered portion 127 that tapers inward toward the front end side toward an inner diameter direction is formed in the intermediate body portion 123.

A center electrode 14 has an enlarged diameter portion 14*a*, and the enlarged diameter portion 14*a* is engaged with the tapered portion 127 of the intermediate body portion 123.

Then, the first predetermined position S is located on the rear end side of the second predetermined position T (the tapered portion 127).

The present embodiment has the following effects with the above configuration.

The same effect as in the first embodiment can be obtained.

Further, since the interval e3 is smaller than the interval e2, it is possible to suppress positions of the main fitting 11 and the insulator 12 at the front end portion Q of the intermediate body portion 123 from being displaced (relative movement).

As a result, it is possible to prevent a center axis of the main fitting 11 and a center axis of the insulator 12 from deviating at the front end portion Q of the intermediate body portion 123, thereby it is possible to prevent the insulator 12 from inclining with respect to the main fitting 11 when the load is applied to the insulator 12, and eventually prevent the insulator 12 from breaking.

The interval between the rear-front end portion 118 and the intermediate body portion 123 is constant at the interval e3 from the front end portion Q of the intermediate body portion 123 to the first predetermined position S on the rear end side.

Therefore, it is possible to further prevent the center axis of the main fitting 11 and the center axis of the insulator 12 from deviating at the front end portion Q of the intermediate body portion 123.

The first predetermined position S is located on the rear end side of the second predetermined position T (the tapered portion 127).

Therefore, the thickness of the insulator 12 can be increased on an outer periphery of the enlarged diameter portion 14*a* where an electric field due to the secondary voltage is likely to be concentrated in the center electrode 14.

Figure 10:
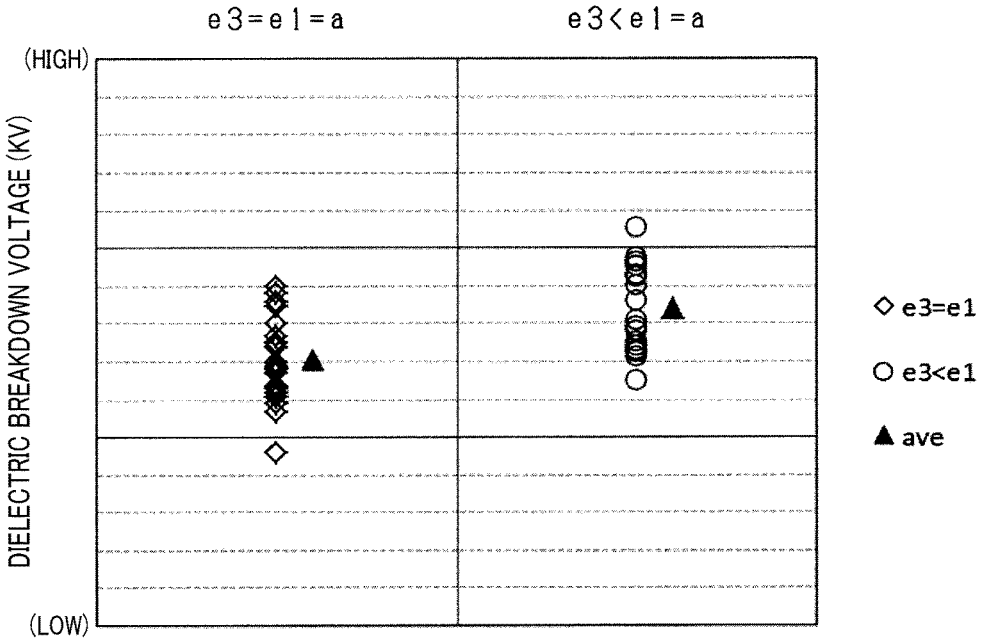
FIG. 10 shows a plot diagram of a breakdown voltage of the first embodiment and a second embodiment.

FIG. 10 shows results of measuring the dielectric breakdown voltage between a vicinity of the enlarged diameter portion 14*a* of the center electrode 14 and an outer peripheral surface of the insulator 12, and the left side shows the result of the first embodiment and the right side shows the result of the second embodiment.

As shown in the figure, the withstand voltage (dielectric breakdown voltage) of the insulator 12 can be improved in the present (second) embodiment.

It should be noted that the above embodiment may be modified as follows.

The interval between the rear-front end portion 118 and the intermediate body portion 123 is constant at the interval e3 from the front end portion Q of the intermediate body portion 123 to the first predetermined position S on the rear end side in the above embodiment.

However, it is also possible to omit a portion where the interval between the rear-front end portion 118 and the intermediate body portion 123 is constant at the interval e3.

That is, the radius r3 (an outer diameter) at the front end portion Q of the intermediate body portion 123 may merely be larger than the radius r1 (an outer diameter) at the rear end portion O of the intermediate body portion 123.

It is also possible to adopt a configuration where the relationship of e2/L2<e1/L1 in the expression (2) is not satisfied, and the radius r3 at the front end portion Q of the intermediate body portion 123 is larger than the radius r1 at the rear end portion O of the intermediate body portion 123.

Even in this case, it is possible to prevent the center axis of the main fitting 11 and the center axis of the insulator 12 from deviating at the front end Q of the intermediate body portion 123, thereby it is possible to prevent the insulator 12 from inclining with respect to the main fitting 11 when the load is applied to the insulator 12, and eventually prevent the insulator 12 from breaking.

What is claimed is:

1. A spark plug, a side where the spark plug is attached to an internal combustion engine being defined as a front end side and a side opposite thereof as a rear end side; the spark plug comprising:

a tubular main fitting, a tubular insulator inserted in the main fitting, and a discharge gap formed on a front end side of the insulator; wherein the main fitting includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion;

the insulator includes a first opposing portion having a predetermined portion opposed to the first portion at a first interval, a second opposed portion opposed to the second portion at a second interval, and a third opposing portion opposed to the third portion and having an outer diameter smaller than that of the second opposing portion;

the predetermined portion projects in a radially outward direction and is a portion having the largest diameter in the first opposing portion;

a connecting portion between the second opposing portion and the third opposing portion is supported by a support portion which is a connecting portion between the second portion and the third portion; and a value obtained by dividing the first interval by a length from the support portion to a rear end portion of the predetermined portion is configured to be smaller than a value obtained by dividing the second interval by a length from the support portion to a rear end portion of the second opposed portion.

2. The spark plug according to claim 1, wherein the first interval is configured to be smaller than the second interval.

3. The spark plug according to claim 1, wherein the first portion includes a thin wall portion having a smaller thickness in a radial direction than other portions of the first portion; and a configuration before the insulator is crimped to the main fitting is configured so that the rear end portion of the predetermined portion is within a range of the thin wall portion in an axial direction.

4. The spark plug according to claim 2, wherein the first portion includes a thin wall portion having a smaller thickness in a radial direction than other portions of the first portion; and a configuration before the insulator is crimped to the main fitting is configured so that the rear end portion of the predetermined portion is within a range of the thin wall portion in an axial direction.

5. The spark plug according to claim 1, wherein the main fitting has a mounting portion in which threads are formed for attaching the spark plug to the internal combustion engine; and a nominal diameter of the mounting portion is M12 or less.

6. The spark plug according to claim 1, wherein the main fitting has a mounting portion in which threads are formed for attaching the spark plug to the internal combustion engine; and a nominal diameter of the mounting portion is M12 or less.

7. The spark plug according to claim 1, wherein the main fitting has a tool engaging portion capable of engaging a predetermined tool;

an outer periphery of the tool engaging portion has a hexagonal shape in a cross section orthogonal to an axis of the main fitting; and an interval between opposing surfaces of the tool engaging portions is 14 mm or less.

8. The spark plug according to claim 1, wherein the main fitting has a tool engaging portion capable of engaging a predetermined tool;

an outer periphery of the tool engaging portion has a hexagonal shape in a cross section orthogonal to an axis of the main fitting; and an interval between opposing surfaces of the tool engaging portions is 14 mm or less.

9. A spark plug, a side where the spark plug is attached to an internal combustion engine being defined as a front end side and a side opposite thereof as a rear end side; the spark plug comprising:

a tubular main fitting, a tubular insulator inserted in the main fitting, and a discharge gap formed on a front end side of the insulator; wherein the main fitting includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion;

the insulator includes a first opposing portion having a predetermined portion opposed to the first portion, a second opposed portion opposed to the second portion, and a third opposing portion opposed to the third portion and having an outer diameter smaller than that of the second opposing portion;

the predetermined portion projects in a radially outward direction and is a portion having the largest diameter in the first opposing portion;

a connecting portion between the second opposing portion and the third opposing portion is supported by a support portion which is a connecting portion between the second portion and the third portion;

when defining a first interval as an interval between the first portion and the predetermined portion at a rear end portion of the predetermined portion, and a second interval as an interval between the second portion and the second opposed portion at the rear end portion of the second opposed portion, a value obtained by dividing the first interval by a length from the support portion to the rear end portion of the predetermined portion is configured to be smaller than a value obtained by dividing the second interval by a length from the support portion to the rear end portion of the second opposed portion; and a third interval, which is an interval between the second portion and the second opposing portion at a front end portion of the second opposing portion, is configured to be smaller than the first interval.

10. The spark plug according to claim 9, wherein an interval between the second portion and the second opposing portion is constant in the third interval from the front end portion of the second opposing portion to a first predetermined position on the rear end side of the second opposing portion.

11. The spark plug according to claim 10, wherein an inner diameter of the second opposing portion on the front end side from a second predetermined position is smaller than an inner diameter on the rear end side of the second predetermined position; and the first predetermined position is located on the rear end side of the second predetermined position.

12. The spark plug according to claim 9, wherein the main fitting has a mounting portion in which threads are formed for attaching the spark plug to the internal combustion engine; and a nominal diameter of the mounting portion is M12 or less.

13. The spark plug according to claim 9, wherein the main fitting has a tool engaging portion capable of engaging a predetermined tool;

an outer periphery of the tool engaging portion has a hexagonal shape in a cross section orthogonal to an axis of the main fitting; and an interval between opposing surfaces of the tool engaging portions is 14 mm or less.

14. A spark plug, a side where the spark plug is attached to an internal combustion engine being defined as a front end side and a side opposite thereof as a rear end side; the spark plug comprising:

a tubular main fitting, a tubular insulator inserted in the main fitting, and a discharge gap formed on a front end side of the insulator; wherein a semi-finished product of the spark plug is a spark plug in a state before the main fitting is crimped to the insulator; the main fitting of the semi-finished product of the spark plug includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion;

the insulator includes a first opposing portion having a predetermined portion opposed to the first portion at a first interval, a second opposed portion opposed to the second portion at a second interval, and a third opposing portion opposed to the third portion and having an outer diameter smaller than that of the second opposing portion;

the first portion includes a thin wall portion having a smaller thickness in a radial direction than other portions of the first portion in the main fitting;

the predetermined portion projects in a radially outward direction and is a portion having the largest diameter in the first opposing portion;

a rear end portion of the predetermined portion is within a range of the thin wall portion in an axial direction;

a connecting portion between the second opposing portion and the third opposing portion is supported by a support portion which is a connecting portion between the second portion and the third portion; and a value obtained by dividing the first interval by a length from the support portion to a rear end portion of the predetermined portion is configured to be smaller than a value obtained by dividing the second interval by a length from the support portion to a rear end portion of the second opposed portion.

15. A spark plug, a side where the spark plug is attached to an internal combustion engine being defined as a front end side and a side opposite thereof as a rear end side; the spark plug comprising:

a tubular main fitting, a tubular insulator inserted in the main fitting, and a discharge gap formed on a front end side of the insulator; wherein a semi-finished product of the spark plug is a spark plug in a state before the main fitting is crimped to the insulator; the main fitting of the semi-finished product of the spark plug includes a first portion, a second portion having an inner diameter smaller than that of the first portion and disposed adjacent to the first portion on a front end side of the first portion, and a third portion having an inner diameter smaller than that of the second portion and disposed adjacent to the second portion on a front end side of the second portion;

the insulator includes a first opposing portion having a predetermined portion opposed to the first portion, a second opposed portion opposed to the second portion, and a third opposing portion opposed to the third portion and having an outer diameter smaller than that of the second opposing portion;

the first portion includes a thin wall portion having a smaller thickness in a radial direction than other portions of the first portion in the main fitting;

the predetermined portion projects in a radially outward direction and is a portion having the largest diameter in the first opposing portion;

a rear end portion of the predetermined portion is within a range of the thin wall portion in an axial direction;

a connecting portion between the second opposing portion and the third opposing portion is supported by a support portion which is a connecting portion between the second portion and the third portion;

when defining a first interval as an interval between the first portion and the predetermined portion at a rear end portion of the predetermined portion, and a second interval as an interval between the second portion and the second opposed portion at the rear end portion of the second opposed portion, a value obtained by dividing the first interval by a length from the support portion to the rear end portion of the predetermined portion is configured to be smaller than a value obtained by dividing the second interval by a length from the support portion to the rear end portion of the second opposed portion; and a third interval, which is an interval between the second portion and the second opposing portion at a front end portion of the second opposing portion, is configured to be smaller than the first interval.

* * * * *